US005341658A

United States Patent [19]

Roach et al.

[11] Patent Number: 5,341,658

[45] Date of Patent: Aug. 30, 1994

[54] FAIL SAFE MECHANICAL OIL SHUTOFF ARRANGEMENT FOR SCREW COMPRESSOR

[75] Inventors: Jerome C. Roach; Garry E. Andersen, both of La Crosse, Wis.

[73] Assignee: American Standard Inc., New York, N.Y.

[21] Appl. No.: 135,367

[22] Filed: Oct. 12, 1993

Related U.S. Application Data

[63] Continuation of Ser. No. 74,284, Jun. 8, 1993, abandoned, which is a continuation-in-part of Ser. No. 926,797, Aug. 7, 1992, abandoned.

[51] Int. Cl.[5] ..... F25B 43/02

[52] U.S. Cl. ..... 62/468; 62/498; 418/84; 418/87; 418/99; 418/201.2

[58] Field of Search ..... 62/468, 498; 418/84, 418/87, 99, 201.2

[56] References Cited

U.S. PATENT DOCUMENTS 3,243,103 3/1966 Bellmer ..... 418/87
3,905,729 9/1975 Bauer ..... 418/84
4,497,185 2/1985 Shaw ..... 418/99
4,762,469 8/1988 Tischer ..... 417/279

FOREIGN PATENT DOCUMENTS 0162434 11/1985 European Pat. Off. .
636782 3/1950 United Kingdom .

*Primary Examiner*—Ronald C. Capossela
*Attorney, Agent, or Firm*—William J. Beres; William O'Driscoll; Peter D. Ferguson

[57] ABSTRACT

Apparatus as disposed internal of a refrigeration screw compressor which, upon compressor shutdown, shuts off the flow of oil injected into the compressor's working chamber and the oil which is directed to the compressor rotor bearings and which at compressor startup opens oil flow to those locations by the use of ambient internal compressor conditions that inherently exist at those respective times. The operation of the apparatus is therefore "fail safe" and the need for external oil flow cutoff valving and the need to monitor and/or prove oil flow within the compressor is eliminated.

19 Claims, 3 Drawing Sheets

FAIL SAFE MECHANICAL OIL SHUTOFF ARRANGEMENT FOR SCREW COMPRESSOR

This application is a continuation of 08/074,284, filed Jun. 8, 1993, abandoned which is of continuation-in-part of 07/926,797, filed Aug. 7, 1992, abandoned.

The present invention relates generally to the art of compressing a gas in an oil-injected rotary screw compressor. More specifically, the present invention relates to apparatus for isolating rotor bearing lubricant passages and the oil injection port, which opens into the working chamber of an oil injected screw compressor, from their oil supply upon compressor shut down.

Screw compressors employed in refrigeration systems are comprised of complementary male and female screw rotors disposed within a working chamber defined by a rotor housing. The working chamber can be characterized as a volume generally shaped as a pair of parallel intersecting cylindrical bores and is closely toleranced to the outside length and diameter dimensions of the intermeshed screw rotor set. The rotor housing has low and high pressure ends which define unvalved suction and discharge ports in open-flow communication with the working chamber.

In operation, refrigerant gas at suction pressure enters the working chamber via the suction port and is enveloped in a chevron shaped pocket formed between the counter-rotating screw rotors. The pocket closes, its volume decreases and it is displaced toward the high pressure end of the compressor as the rotors meshingly rotate within the working chamber. The gas within such a pocket is compressed by virtue of the decreasing volume in which it is contained until the pocket opens to the discharge port at the high pressure end of the working chamber where it is expelled through the discharge port.

Due to the extremely close tolerances between the rotor set and the walls of the working chamber, the bearing arrangement in which the rotor set is mounted is critical to compressor operation and life. This is particularly true because the bearings and rotors in a screw compressor are subject to high and variable axial and radial loads. Protection and lubrication of rotor bearings is therefore of paramount concern in the design and operation of rotary screw compressors.

In addition to being delivered to the rotor bearings, oil is in many instances injected into the working chamber of a screw compressor through an injection port to perform several functions. First, the oil injected into the working chamber acts as a sealant between the rotors and the surfaces of the working chamber in which the rotors are disposed.

The oil also acts as a lubricant between the driving and driven screw rotor. In that regard, one of the two screw rotors is driven by an external source, such as an electric motor, while the other rotor is driven by virtue of its meshing relationship with the motor-driven rotor. Oil injected into the working chamber of the compressor therefore acts to prevent excessive wear between the driving and driven rotors.

Finally, injected oil is used to cool the refrigerant undergoing compression within the working chamber which in turn reduces the thermal expansion of the rotors that would otherwise occur as a result of the heat generated by the compression process. Such injection cooling therefor permits tighter rotor to housing clearances from the outset.

At compressor shut down, when the drive motor is de-energized, the backflow of discharge pressure gas from the high (downstream) side of the refrigeration system in which a screw compressor is employed back through the compressor discharge port, if allowed to occur, causes the high speed reverse direction rotation of the no longer driven screw rotors within the working chamber and causes the compressor to act as an expander with respect to gas downstream of the discharge port. Such reverse direction freewheeling of the rotors can occur at speeds greater than the maximum design RPM of the rotor set for normal operation.

Additionally, to the extent gas backflow is cutoff at shutdown, such as by a check valve arrangement, the initial rush of downstream discharge pressure gas back through the compressor toward the low pressure side of the refrigeration system may still be sufficient to cause the pressure at the suction end of the compressor to exceed that which exists immediately downstream of the discharge port. This situation can occur when the compressor, acting as an expander in its reverse direction rotation, pumps against the closed discharge check valve, and can result in the development of large axial forces on the screw rotor set and rotor bearings in a direction opposite that which is normally encountered and compensated for during compressor operation.

Also, many screw compressor bearing lubrication schemes are predicated on the development and maintenance of relatively high pressure downstream of the compressor which is used to drive lubricating oil from a sump or reservoir to the rotor bearings and/or injection port. The high speed reverse rotation of the rotor set at compressor shutdown and momentary development of relatively higher pressure at the upstream or low side end of the working chamber, if allowed to occur, could, under some circumstances, cause oil to be sucked from the bearings or not to be delivered to the bearings in sufficient quantity with potentially catastrophic results.

Finally, unless the oil injection port opening into the working chamber of a screw compressor is isolated from its typically pressurized oil supply upon compressor shutdown, oil will continue to flow through the injection port into the working chamber after shutdown, until the system pressures equalize, by virtue of the pressure differential which exists between the oil supply and the working chamber at compressor shutdown. Absent means for reliably isolating the oil injection port from its oil supply under such circumstances, the working chamber can become flooded with oil. As a result, the compressor lubrication system can become starved for oil due to the dislocation of the oil supply from the oil sump to the working chamber and insufficient oil may be available for delivery to the necessary locations within the compressor when the compressor next starts with potentially catastrophic results.

The need, therefore, continues to exist for a fail safe arrangement for preventing the continued flow of oil to the bearings and through the injection port into the working chamber of a refrigeration screw compressor upon compressor shut down and for permitting such oil flow at compressor startup.

SUMMARY OF THE INVENTION

It is an object of the present invention to isolate the bearing lubrication passages and the oil injection port which opens into the working chamber of a screw compressor from their oil supply upon compressor shutdown in a manner which is actuated by the existence of discharge pressure gas immediately downstream of the compressor's working chamber when the compressor is in operation.

A further object of the present invention is to provide an arrangement which, by the act of compressing gas and discharging it from the compressor's working chamber upon compressor start up, immediately and mechanically places the bearing lubrication passages and oil injection port into flow communication with their oil supply.

It is also an object of the present invention to provide mechanical apparatus for closing the bearing lubrication passages and oil injection port of a screw compressor immediately upon compressor shutdown and for opening them immediately upon startup in a manner which, by its use of ambient conditions which are inherent within the compressor at those respective times, is "fail safe" and eliminates the need for external check valves, solenoid valves or sensors to "prove" oil flow within the compressor.

These and other objects of the present invention, which will become apparent when the Drawing Figures and the Description of the Preferred Embodiment hereof are considered, are accomplished by apparatus disposed within a screw compressor which shuts off the flow of injection and bearing lubrication oil in the compressor at compressor shutdown and which permits flow to occur at compressor startup by the use of the internal pressure differentials and gas flow which are inherent in the compressor and its operation at those respective times.

Discharge pressure, which exists immediately downstream of the compressor's discharge port when the compressor is in operation, is used to position a spool valve against internal compressor suction pressure to a position which permits the flow of lubricating oil from an oil supply to bearing locations and to the oil injection port opening into the compressor's working chamber. At compressor shutdown the backflow of discharge pressure gas to the compressor's working chamber closes an internal discharge check valve causing an immediate pressure differential to develop across the spool valve. The pressure differential operates to position the spool valve to isolate the oil supply from the bearings and injection port. Upon compressor startup discharge pressure develops downstream of the compressor's working chamber and acts on the spool valve causing it to be positioned to permit oil flow within the compressor so that oil is immediately directed to the bearings and oil injection port.

BRIEF DESCRIPTION OF THE DRAWING FIGURES

DESCRIPTION OF THE PREFERRED EMBODIMENT

Figure 1:
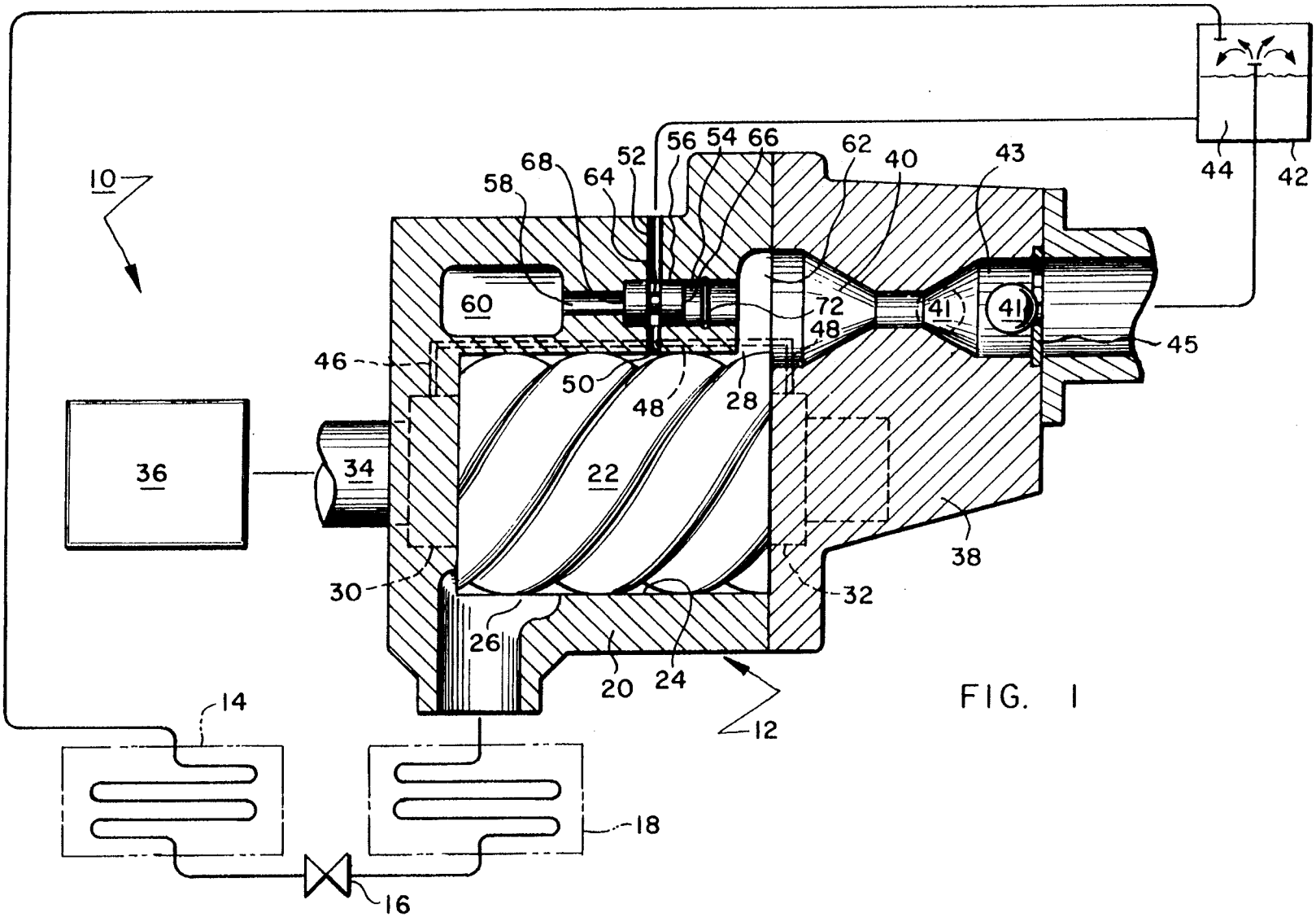
FIG. 1 is a cross sectional view of the compressor of the present invention and its schematic disposition in a refrigeration system.
Figure 2:
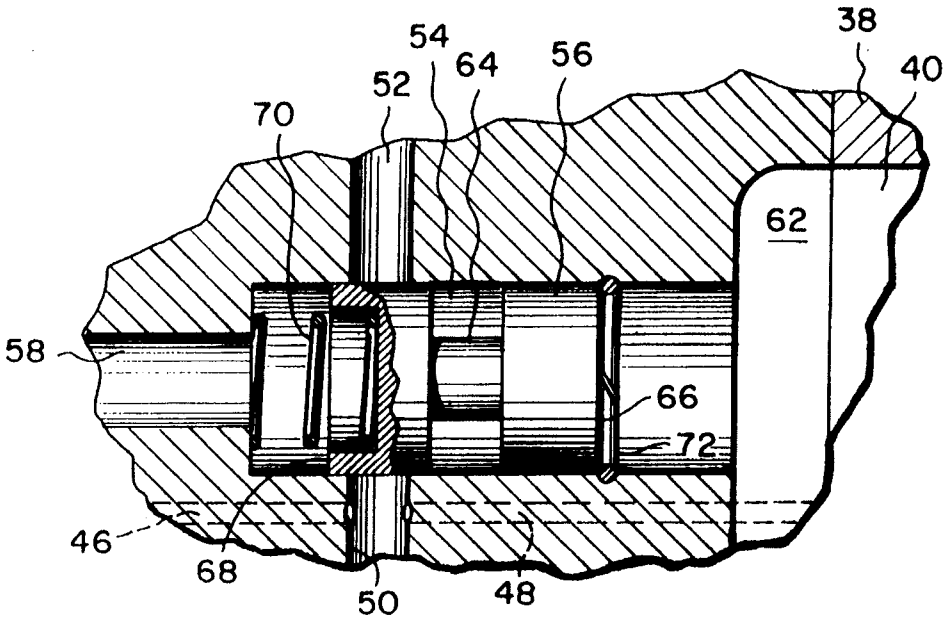
FIG. 2 is an enlarged partial view of the oil shutoff valve installation in the compressor of FIG. 1.

Referring concurrently to Drawing FIGS. 1 and 2, refrigeration system 10 is comprised of a compressor housing assembly 12, condenser 14, expansion valve 16 and evaporator 18 all of which are serially connected to form a hermetic closed loop refrigeration system. Rotor housing 20 of compressor assembly 12 houses a pair of screw rotors one of which, rotor 22, is illustrated. The rotor set is disposed in working chamber 24 of the rotor housing which further defines a suction port 26 and discharge port 28 which are, respectively, the entry and exit locations for refrigerant gas passing through the working chamber during compressor operation.

Rotor 22, in the embodiment of FIG. 1, is the driven one of the pair of screw rotors and is mounted for rotation within the rotor housing in bearings 30 and 32. Rotor 22 has a shaft 34 extending from one of its ends which is driven by motor 36. Bearing housing 38 of the compressor assembly is attached to the discharge end of rotor housing 20 and serves to house bearing 32 and to close the discharge end of the working chamber.

Bearing housing 38 defines a discharge passage 40 in flow communication with discharge port 28 which channels discharge gas out of the compressor assembly. Discharge passage 40 is also in flow communication with oil separator 42 in which lubricant, which has been carried out of compressor housing assembly 12 in the discharge gas stream, is separated from the discharge gas prior to the use of that gas in the refrigeration system.

It is to be noted that a relatively large amount of oil is typically carried out of the compressor's working chamber in the discharge gas stream in an oil-injected screw compressor and that as much of that entrained oil as possible must be removed from the refrigerant gas so as not to degrade downstream refrigeration system performance and to ensure that sufficient lubricant continues to be available to the compressor.

Disposed in discharge passage 40 is a discharge check valve member 41. While check valve member 41 in FIG. 1 is illustrated as being a spherical member trapped in volume 43 against open spider 45, it will be appreciated that a very large number and variety of discharge check valve arrangements are contemplated within the scope of the present invention. The discharge check valve assembly may be disposed in the bearing housing or in the discharge piping which connects the compressor assembly to the oil separator. It must, however, serve to isolate the compressor's working chamber from the oil sump 44 upon compressor shutdown.

Compressor assembly 10 defines a plurality of oil passages including lubrication passages 46 and 48 which communicate with the bearings that support the screw rotors within the compressor assembly and with an oil injection passage 50 which opens into the compressor's working chamber. In the embodiment illustrated in FIGS. 1 and 2, all three passages are in flow communication common oil supply passage 52.

Oil supply passage 52 is in flow communication with sump 44 of oil separator 42. It is to be noted that oil separator 42 and sump 44 may be integral to the compressor assembly and that sump 44 might communicate with supply passage 50 via passages which are entirely internal of the compressor assembly in such instances. Also, oil sump 44 may be physically removed and in a vessel separate from oil separator 42. Once again, however, some means for preventing gas backflow to the working chamber at compressor shutdown must be disposed between the working chamber and oil separator/sump wherever the separator/sump may be located.

Interposed in oil supply passage 52 in rotor housing 20 is a volume 54 in which a valve member 56 is disposed. Volume 54, in addition to being in flow communication with oil supply passage 52 and therefore, internal compressor oil passages 46, 48 and 50, is in flow communication with an area in the compressor assembly which is at a pressure less than discharge pressure and an area within the compressor assembly which, when the compressor is in operation, is at high side or discharge pressure.

In that regard, volume 54 communicates through a passage 58 to area 60 which is a volume within rotor housing 20 that is at suction pressure during compressor operation. Area 60 is in flow communication with suction port 26 within the compressor assembly and is, in effect, upstream thereof within the refrigeration system.

As was indicated above, area 60, rather than being an area of the compressor which is at suction pressure, can be an area within the compressor which is at an intermediate pressure. Area 60 will, however, always be an area which is at less than discharge pressure when the compressor is in operation. Volume 54 also opens into area 62 within which is an area immediately downstream of discharge port 28 that is at discharge pressure. Area 62 is therefore on the high side of the refrigeration system when the compressor is in operation.

It will be appreciated that valve 56 is slideably disposed for axial movement within volume 54 between a first position, illustrated in FIG. 1, in which oil is permitted to flow through passage 52 and chamber 54 to oil passages 46, 48 and 50 around relieved portion 64 of valve member 56 and a second position, illustrated in FIG. 2, in which an unrelieved portion of valve 56 blocks the flow of oil through chamber 54. Valve 56 is positioned to the position illustrated in FIG. 1 by the exposure of its high side end face 66 to the discharge pressure which exists in discharge pressure area 62 whenever the compressor is in operation.

Low side end face 68 of valve 56, on the other hand, is exposed, as earlier mentioned, to an area of the compressor which is at low side or suction pressure through passage 58. The high to low side pressure differential across valve 56 which exists whenever the compressor is in operation ensures that valve 56 is positioned to permit oil flow through chamber 54, as is illustrated in FIG. 1, at all times during compressor operation. This assures, in a fail safe manner which relies on an operating condition which is inherent in the compressor when it is in operation, that oil is permitted to flow from sump 44 to the oil injection port and to the compressor bearings whenever the compressor is operating.

Upon de-energization of motor 36 the compressor is shut down and previously compressed discharge pressure gas will immediately flow back to the working chamber of the de-energized compressor from downstream thereof. The immediate effect of the backflow of the discharge pressure gas is to carry check valve member 41 to the position in which it is illustrated in phantom in FIG. 1.

As soon as check valve member 41 seats in the phantom position illustrated in FIG. 1, the backflow of previously compressed gas from downstream of the compressor to the working chamber will stop. The immediate initial backflow of gas to the working chamber prior to the discharge check valve having seated will, however, have caused the rotors to begin to rotate in a direction opposite the direction they are caused to rotate in operation by motor 36.

This reverse rotation of the rotors has the effect of evacuating gas from discharge area 62 as soon as valve member 41 seats and of lowering the pressure in that area to a pressure which is less than system low side pressure. This is because the rotors, which function as a gas expander by virtue of their reverse direction rotation, act to pump gas from the discharge area against the closed discharge check valve 41 under this condition when it is in its backflow preventing position.

As the pressure in discharge pressure area 62 drops under these circumstances the pressure on high pressure end 66 of valve 56 quickly drops to a pressure which is less than the low side pressure in suction area 60. Under that circumstance, the pressure on low side end face 68 of the spool valve will be greater than the pressure on the high end side face 66 of the valve and the pressure differential across the valve will act to move the valve into the position illustrated in FIG. 2. Once again, it will be appreciated that an ambient condition inherent in the compressor at a particular point in its operation is used to cause oil flow passage 52 to be closed to flow at an appropriate time.

It will be noted from FIG. 2 that valve 56 may be biased by spring 70 toward the FIG. 2 position in which an unrelieved portion of valve member 56 occludes oil supply passage 52. It will also be noted that a retainer ring 72 is disposed in volume 54 and protrudes thereinto permitting valve 56 to travel no further within volume 54 than to the position illustrated in FIG. 2. While spring 70 is not mandatory, it will preferably be used since in addition to assisting the movement of valve 56 to the position in which oil flow is prevented upon compressor shutdown it assists in maintaining the valve in that position as conditions in discharge area 62, which are somewhat transient by nature at compressor shutdown, assume a steady state condition.

When the compressor next starts up subsequent to having been shutdown, the compression of gas between the screw rotors will immediately commence and discharge pressure will quickly build in discharge pressure area 62 causing valve 56 to be urged into the position illustrated in FIG. 1 in which oil supply passage 52 is open to flow. Pressure will concurrently build up in oil separator 42 which will cause oil to flow from sump 44 through oil supply passage 52 to the compressor bearings and oil injection port.

Figures 3, 4:
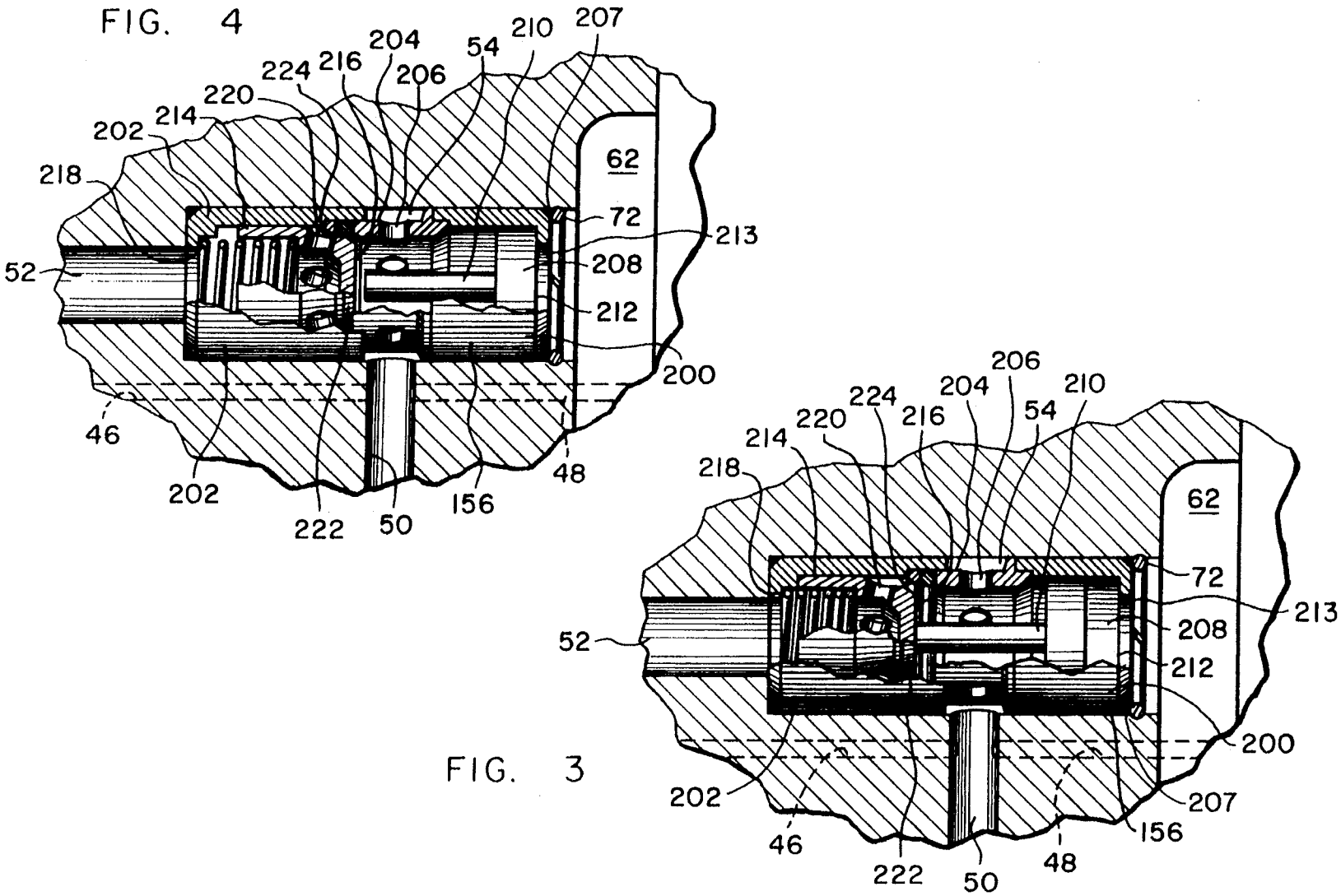
FIGS. 3 and 4 are enlarged partial views of an alternative oil shutoff valve installation of the compressor assembly of FIG. 1 showing the valve in flow and no flow positions respectively.

Referring now to FIGS. 3 and 4, an alternative arrangement to that of FIGS. 1 and 2 is described. With respect to FIGS. 3 and 4, like components, features and parts are numbered identically to their respective corresponding FIG. 1 and 2 counterparts.

In the FIG. 3 and 4 embodiment, valve member 156 is disposed in volume 54 and is retained therein by ring 72 in a manner similar to that of its FIG. 1 and 2 counterpart. In FIG. 3, however, passage 58 which, in the FIGS. 1 and 2 embodiments is in flow communication with an area of the compressor which is at suction pressure during compressor operation, is dispensed with and oil supply passage 52 is reconfigured to flow axially into volume 54 rather than at the 90° angle illustrated in FIGS. 1 and 2.

Whereas valve member 56 in the embodiment of FIGS. 1 and 2 is a unitary valve member, valve member 156 in the FIGS. 3 and 4 embodiment is comprised of a number of discrete components. In that regard, valve member 156 is comprised of a first housing 200, a second housing 202 and an intermediate portion 204 in which a plurality of apertures 206 are defined. O-rings 207 are disposed at either end of valve member 156 to prevent oil leakage around second housing 202 from passage 58 and gas leakage around first housing 200 from discharge area 62.

Disposed for axial movement within first housing 200 of valve member 156 is a free-floating piston 208 from which a stem 210 extends. Piston 208 has an end face 212 which is exposed, through aperture 213 in housing 200, to the discharge pressure which exists in discharge pressure area 62, when the compressor assembly 12 is in operation.

Disposed in second housing 202 is a second piston 214 which is axially slideable therein. Second piston 214 has an end face 216 which, as will be described, is contacted by and acted upon by stem 210 of first piston 208 when the compressor is in operation. Second piston 214 is likewise acted upon, but in a direction opposite the action of stem 210 of piston 208, by a spring 218 which is seated in second housing 202.

Second piston 214 defines a plurality of apertures 220 as well as a seating surface 222 which faces a cooperative seating surface 224 defined within second housing 202. As is indicated in the drawing figures, piston 208, together with its stem 210, is a pilot valve which is disposed for axial movement in first housing 200. Piston 208 is not physically attached to second piston 214 in second housing portion 202. As will be appreciated from FIGS. 3 and 4, depending upon compressor operating condition, stem 210 of piston 208 may or may not be in contact with end face 216 of second piston 214.

Referring to FIG. 4, when compressor assembly 12 is shut down the pressure in discharge area 62 decreases rapidly as a result of the near immediate seating of discharge check valve 41 (see valve 41 in phantom in FIG. 1) due to discharge gas backflow and the evacuation of discharge gas from discharge area 62 due to reverse rotor rotation as is set forth above. Residual pressure in passage 52 and spring 218 of valve member 156 concurrently and with near immediate effect urge second piston 214 into a position wherein its seating surface 222 is in sealing abutment with seating surface 224 within second housing member 202. The movement caused by spring 218 to seat second piston 214 on seating surface 222 is communicated to and positions first piston 208 (through stem 210) which, because of the immediately decreased pressure in discharge area 62, offers essentially no resistance to movement.

When compressor 12 starts up, discharge pressure immediately develops in compressor discharge area 62 and acts on end face 212 of piston 208 with a force sufficient to overcome the resisting force of spring 218. As a result, stem 210 is urged into contact with and acts upon end face 216 of second piston 214 which is urged axially away from seat 224 thereby.

The movement of second piston 214 away from seat 224 opens a path by which oil can flow from oil supply passage 52, through apertures 220 and past seat 224, around second piston 214 and thence through apertures 206 in intermediate portion 204 of valve member 156 to oil passages 46, 48 and 50. It will be appreciated that the surface area of end face 216 of second piston 214 is sized such that whenever compressor 12 is in operation, sufficient force is brought to bear on it to maintain second piston 214 in a position illustrated in FIG. 3 which permits the flow of oil from oil supply passage 52 to oil passages 46, 48 and 50.

As is set forth above, when the compressor shuts down, the residual pressure in passage 52 and the force of spring 218 causes piston 214 to move into the seated position illustrated in FIG. 4. The flow of oil to passages 46, 48 and 50 from oil supply passage 52 is thereby quickly cutoff.

The primary advantage of the FIG. 3 and 4 embodiment over the embodiment of FIGS. 1 and 2 is the provision of seating surface 224 with which seating surface 222 of second piston 214 creates a positive seal within valve member 156 upon compressor shutdown. In the embodiment of FIGS. 1 and 2, it will be appreciated that in the "closed" position illustrated in FIG. 2 leakage has the potential to occur around the circumferential periphery of the cylindrical portion of valve member 56 which shuts off oil supply passage 52 from passages 46, 48 and 50. To the extent leakage does occur within compressor 12 subsequent to compressor shut down, the possibility exists for the compressor working chamber to become flooded with oil and/or for there to be insufficient lubricant in the system oil separator to supply lubricant to the necessary bearing and sealing surfaces within the compressor immediately subsequent to compressor start up.

It is to be noted that valve member 156 of the FIGS. 3 and 4 embodiment is commercially available from the Kepner Products Company, 995 N. Ellsworth Avenue, Villa Park, Ill. 60181 and that valve member 156 is the subject of expired U.S. Pat. Nos. 2,959,188 and 3,335,750. The application of valve member 156 to a screw compressor for positive oil flow cutoff is, however, unique as evidenced by the fact that valve member 156, in its commercially available configuration presumes flow in the direction opposite that to which flow occurs in its application in the screw compressor of the present invention. That is, valve member 156 is applied, in the present invention, in a unique manner and setting which is apparently not contemplated by its manufacturer.

It will be appreciated that since the oil shutoff arrangement of the present invention is mechanical and fail safe, relying on inherent internal compressor operating conditions for actuation at appropriate times, the need for monitoring the position of the shutoff valve and/or the need to "prove" oil flow to the compressor bearings and oil injection port at compressor startup is avoided. The arrangement of the present invention likewise eliminates the need for electrical or electronic sensing and/or monitoring with respect to oil flow during compressor operation and, with respect to some systems, the need to employ a relatively expensive solenoid operated valve, which is subject to electrical failure, in the compressor oil supply line.

What is claimed is:

1. A rotary screw refrigerant gas compressor comprising:

a housing defining a working chamber, said housing further defining a suction port, a discharge port and an oil supply passage, all in flow communication with said working chamber, said housing further defining an oil flow cutoff passage which is in flow communication with said oil supply passage, with an area in said compressor which is at a pressure less than compressor discharge pressure when said compressor is in operation and with an area in said compressor downstream of said discharge port which is at compressor discharge pressure when said compressor is in operation; and a pair of screw rotors meshingly disposed for rotation in said working chamber; and valve means disposed within said compressor and positionable to (i) occlude said oil supply passage to prevent the flow of oil therethrough and to (ii) open said oil passage to permit the flow of oil therethrough in direct response to ambient conditions in said compressor downstream of said discharge port which inherently exist at compressor shutdown and startup respectively.

2. The screw compressor according to claim 1 wherein said valve means is comprised of means for stopping the backflow of said refrigerant gas to said working chamber from downstream thereof immediately subsequent to compressor shutdown; and, a discrete valve member disposed in said oil flow cutoff passage.

3. The screw compressor according to claim 2 wherein said valve member has an upstream surface exposed to the pressure which exists in said area which is at less than discharge pressure when said compressor is in operation and a downstream surface exposed to pressure in said area downstream of said discharge port, the position of said valve means being dependent upon the pressure differential across said valve member.

4. The screw compressor according to claim 3 wherein the stoppage of gas backflow subsequent to compressor shutdown causes the pressure in said area downstream of said discharge port to become less than pressure on said upstream surface of said valve member so that said valve member is urged by the pressure on said upstream surface into said position in which said oil supply passage is occluded and wherein, upon compressor startup, pressure in said area downstream of said discharge port is caused to increase due to the compression of said gas in said working chamber to an extent such that the pressure in said area downstream of said discharge port and on said downstream valve member surface surpasses the pressure on said area upstream valve member surface thereby urging said valve member into a position in which oil flow through said oil supply passage is permitted.

5. The screw compressor according to claim 4 wherein said valve member is a spool valve defining a relieved portion between said upstream surface and said downstream surface, the flow of oil through said oil supply passage being permitted by the registry of said relieved portion of said spool valve with said oil supply passage internal of said compressor and the flow of oil through said oil supply passage being prevented by the movement of said spool valve to a position in said oil cutoff passage in which said relieved portion is out of registry with said oil supply passage.

6. The screw compressor according to claim 5 further comprising means for mechanically biasing said spool valve to a position within said oil cutoff passage in which the flow of oil through said oil supply passage is prevented.

7. The screw compressor according to claim 5 wherein said area which is less than discharge pressure when said compressor is in operation is at suction pressure when said compressor is in operation.

8. A screw compressor comprising:

a housing defining a working chamber, an oil supply passage and an oil cutoff passage, said housing further defining a suction port and a discharge port in flow communication with said working chamber, said oil cutoff passage being in flow communication with said oil supply passage and communicating between an area in said compressor downstream of said discharge port and an area in said compressor which is at a pressure less than compressor discharge pressure when said compressor is in operation, said downstream area being in flow communication with said discharge port;

a pair of screw rotors meshingly disposed in said working chamber;

means for driving one of said screw rotors;

means for stopping the backflow of gas to said working chamber from downstream thereof immediately subsequent to the stoppage of said means for driving one of said screw rotors motor; and valve means disposed in said first passage, said valve means having an upstream surface exposed to pressure in said area which is at less than discharge pressure when said compressor is in operation and a downstream surface exposed to pressure in said area downstream of said discharge port, said valve means being positionable to occlude the flow of oil through said oil supply passage by the pressure differential which develops across said valve means subsequent to the operation of said means for stopping backflow to stop gas backflow.

9. The compressor according to claim 8 wherein said screw rotors are mounted in bearings for rotation in said working chamber and wherein said oil supply passage is in flow communication with said bearings and an injection port opening into said working chamber.

10. The compressor according to claim 9 wherein said valve means is a spool valve mechanically biased to occlude said oil supply passage, said mechanical biasing being overcome, so that said spool valve is positioned to permit flow through said oil supply passage, by the development of pressure in said area downstream of said discharge port which is sufficient to overcome the mechanical bias and the effect of the pressure on the side of said spool valve which is exposed to said area which is at less than discharge pressure when said compressor is in operation.

11. What is claimed is a screw compressor-based refrigeration system comprising:

an oil supply;

a condenser;

an expansion valve;

an evaporator; and a screw compressor, said compressor, condenser, expansion valve and evaporator being serially connected to form a hermetically closed refrigeration system having a high pressure side, downstream of said compressor and upstream of said expansion valve, and a low pressure side, downstream of said expansion valve and upstream of said compressor, said compressor having locations which are at a pressure intermediate compressor discharge pressure and compressor suction pressure when said compressor is in operation, said compressor (i) defining a working chamber in which a pair of screw rotors are disposed, an oil supply passage in flow communication with said oil supply, a suction port in open flow communication with said working chamber and with said low pressure side of said system, a discharge port in open flow communication with said working chamber and said high pressure side of said system, an oil cutoff passage in flow communication with the high pressure side of said system, with one of said intermediate pressure locations in said compressor and with said oil supply passage; and (ii) having valve means disposed in said cutoff passage, said valve means being positioned to prevent flow through said oil supply passage by the ambient conditions which inherently exist internal of said compressor immediately subsequent to compressor shutdown and being positioned to permit the flow of oil through said oil supply passage by the ambient conditions which inherently exist internal of said compressor immediately subsequent to compressor startup.

12. The screw compressor-based refrigeration system of claim 11 wherein said valve means is comprised of means for stopping the backflow of refrigerant gas to said working chamber from downstream thereof immediately subsequent to compressor shutdown; and, a discrete valve member disposed in said oil cutoff passage.

13. The screw compressor-based refrigeration system according to claim 13 wherein said valve member has an upstream surface exposed to pressure in said one of said intermediate pressure locations in said compressor and a downstream surface exposed to pressure in said high pressure side of said refrigeration system, the position of said valve member being dependent upon the pressure differential across said valve member.

14. The screw compressor-based refrigeration system according to claim 13 wherein the stoppage of gas backflow subsequent to compressor shutdown causes the pressure to which said downstream surface of said valve member is exposed to become less than the pressure to which said upstream valve member surface is exposed so that said valve member is urged by the pressure on said upstream surface into a position which prevents the flow of oil through said oil supply passage.

15. The screw compressor-based refrigeration system according to claim 14 wherein said valve member is a spool valve defining a relieved portion between said upstream surface and said downstream surface, the flow of oil through said oil supply passage being permitted by the registry of said relieved portion of said spool valve with said oil supply passage and the flow of oil through said oil supply passage being prevented by the movement of said spool valve to a position in said oil cutoff passage in which said relieved portion is moved out of registry with said oil supply passage.

16. The screw compressor-based refrigeration system according to claim 15 further comprising means for mechanically biasing said spool valve to a position within said oil cutoff passage in which the flow of oil through said oil supply passage is prevented.

17. The screw compressor-based refrigeration system according to claim 12 wherein said oil flow cutoff passage is in flow communication with said low pressure side of said refrigeration system; and, wherein said valve member has an upstream surface exposed to pressure in said low pressure side of said refrigeration system and a downstream surface exposed to pressure in said high pressure side of said refrigeration system, the position of said valve member being dependent upon the pressure differential across said valve member.

18. The screw compressor-based refrigeration system according to claim 17 wherein said valve member is a spool valve which defines a relieved portion between said upstream surface and said downstream surface, the flow of oil through said oil supply passage being permitted by the registry of said relieved portion of said spool valve with said oil supply passage and the flow of oil through said oil supply passage being prevented by the movement of said spool valve to a position in said oil cutoff passage in which said relieved portion is moved out of registry with said oil supply passage.

19. The screw compressor-based refrigeration system according to claim 18 further comprising means for mechanically biasing said spool valve to a position with said oil cutoff passage in which the flow of oil through said oil supply passage is prevented.

* * * * *

UNITED STATES PATENT AND TRADEMARK OFFICE

CERTIFICATE OF CORRECTION

PATENT NO. : 5,341,658

DATED : August 30, 1994

INVENTOR(S) : Jerome C. Roach, et. al.

It is certified that error appears in the above-indentified patent and that said Letters Patent is hereby corrected as shown below:

Claim 13, Column 11, line 19, "13" should read --12--.

Signed and Sealed this

First Day of November, 1994

*Attest:*

*Attesting Officer*

Bruce Lehman

BRUCE LEHMAN

*Commissioner of Patents and Trademarks*